US006936307B2

(12) United States Patent
Dauchelle et al.

(10) Patent No.: US 6,936,307 B2
(45) **Date of Patent: *Aug. 30, 2005**

(54) METHOD AND INSTALLATION FOR DIP COATING OF A METAL STRIP

(75) Inventors: Didier Dauchelle, Creil (FR); Hugues Baudin, Teteghem (FR); Patrice Lucas, Lyons (FR); Laurent Gacher, Sarreguemines (FR); Yves Prigent, Roberval (FR)

(73) Assignee: Usinor, Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/416,192

(22) PCT Filed: Nov. 7, 2001

(86) PCT No.: PCT/FR01/03455

§ 371 (c)(1),
(2), (4) Date: Oct. 21, 2003

(87) PCT Pub. No.: WO02/38824

PCT Pub. Date: May 16, 2002

(65) Prior Publication Data

US 2004/0052958 A1 Mar. 18, 2004

(30) Foreign Application Priority Data

Nov. 10, 2000 (FR) ..... 00 14480

(51) Int. Cl.[7] ..... B05D 1/18; B05C 3/00

(52) U.S. Cl. ..... 427/436; 427/433; 427/434.2; 118/419; 118/429

(58) Field of Search ..... 427/431, 432, 427/433, 434.2, 434.5, 435, 436, 443.2; 118/419, 423, 429

(56) References Cited

U.S. PATENT DOCUMENTS 4,759,807 A * 7/1988 Sippola ..... 148/533

FOREIGN PATENT DOCUMENTS

JP 2-305948 A * 12/1990
JP 3-150338 A * 6/1991
JP 5-279827 A * 10/1993
JP 2001-335906 A * 12/2001

OTHER PUBLICATIONS

JPO computer translation of JP 5–279827 A, published Oct. 1993.*

Patent Abstracts of Japan, vol. 016, No. 375, Aug. 1, 1992 & JP 04 120258 (Kawasaki Steel Corp), Apr. 21, 1992.

Patent Abstracts of Japan, vol. 018, No. 068, Feb. 4, 1994 & JP 05 279827 (Kawasaki Steel Corp), Oct. 26, 1993.

* cited by examiner

*Primary Examiner*—Timothy Meeks
*Assistant Examiner*—David Turocy
(74) *Attorney, Agent, or Firm*—Sughrue Mion, PLLC

(57) ABSTRACT

A process for the continuous dip-coating of a metal strip (1) in a tank (11) containing a liquid metal bath (12), in which process the metal strip (1) is made to run continuously through a duct (13), the lower part **(13*a*) of which is immersed in the liquid metal bath (12) in order to define with the surface of the said bath a seal (14). A natural flow of the liquid metal from the surface of the liquid seal is set up in an overflow compartment (25) made in the duct (13) and having an internal wall which extends the duct (13) in its lower part, and the level of liquid metal in the compartment (25) is maintained at a level below the surface of the liquid seal (14)**. Also, a plant for implementing the process.

18 Claims, 4 Drawing Sheets

METHOD AND INSTALLATION FOR DIP COATING OF A METAL STRIP

BACKGROUND OF THE INVENTION

The present invention relates to a process and a plant for the continuous hot dip-coating of a metal strip, especially a steel strip.

In many industrial applications, steel sheet is used which is coated with a protective layer, for example for corrosion protection, and usually coated with a zinc layer.

This type of sheet is used in various industries to produce all kinds of parts, in particular visual parts.

To obtain this kind of sheet, continuous dip-coating plants are used in which a steel strip is immersed in a bath of molten metal, for example zinc, which may contain other chemical elements, such as aluminium and iron, and possible addition elements such as, for example, lead, antimony, etc. The temperature of the bath depends on the nature of the metal, and in the case of zinc the temperature of the bath is around 460° C.

In the particular case of hot galvanising, as the steel strip runs through the molten zinc bath, an Fe—Zn—Al intermetallic alloy with a thickness of a few tens of nanometers forms on the surface of the said strip.

The corrosion resistance of the parts thus coated is provided by the zinc, the thickness of which is controlled usually by air wiping. The adhesion of the zinc to the steel strip is provided by the layer of the aforementioned intermetallic alloy.

Before the steel strip passes through the molten metal bath, this steel strip firstly runs through an annealing furnace in a reducing atmosphere where the purpose is to recrystallise it after the substantial work hardening resulting from the cold-rolling operation and to prepare its surface chemical state so as to favour the chemical reactions necessary for the actual dip-coating operation. The steel strip is heated to about 650 to 900° C. depending on the grade, for the time needed for recrytallisation and surface preparation. It is then cooled to a temperature close to that of the bath of molten metal by means of heat exchangers.

After it has passed through the annealing furnace, the steel strip runs through a duct, also called a "snout", containing an atmosphere which protects the steel, and is immersed in the bath of molten metal.

The lower part of the duct is immersed in the bath of metal in order to define, with the surface of the said bath and inside this duct, a liquid seal through which the steel sheet passes as it runs through the said duct.

The steel strip is deflected by a roller immersed in the metal bath. It emerges from this metal bath and then passes through wiping means used to regulate the thickness of the liquid metal coating on this steel strip.

In the particular case of hot galvanising, the surface of the liquid seal inside the duct is generally covered with zinc oxide, coming from the reaction between the atmosphere inside this duct and the zinc of the liquid seal and with solid dross particles coming from the steel strip dissolution reaction.

These dross or other particles, in supersaturation in the zinc bath, have a density less than that of the liquid zinc and rise to the surface of the bath and especially to the surface of the liquid seal.

The running of the steel strip through the surface of the liquid seal causes entrainment of the stagnant particles.

These particles entrained by the movement of the liquid seal, which depends on the speed of the steel strip, are not removed from the volume of the bath and emerge in the region where the strip is extracted, creating visual defects.

Thus, the coated steel strip has visual defects which are magnified or revealed during the zinc wiping operation.

This is because the foreign particles are retained by the air wiping jets before the said particles are ejected or broken up, thus creating streaks of lesser thickness in the liquid zinc having a length ranging from a few millimeters to a few centimeters.

Various solutions have been proposed to try to remove the zinc particles and the dross from the surface of the liquid seal.

A first solution for avoiding these drawbacks consists in cleaning the surface of the liquid seal by pumping off the zinc oxides and dross coming from the bath.

These pumping operations allow the surface of the liquid seal to be cleaned only very locally at the point of pumping and their effectiveness and range of action are very low, which does not guarantee that the liquid seal through which the steel strip passes is completely cleaned.

A second solution consists in reducing the area of the liquid seal at the point through which the steel strip passes by placing a sheet-metal or ceramic plate at this liquid seal in order to keep some of the particles present at the surface away from the strip and to achieve self-cleaning of the liquid seal by this strip.

This arrangement does not keep away all the particles present at the surface of the liquid seal and the self-cleaning action is greater the smaller the area of the liquid seal, this being incompatible with industrial operating conditions.

Furthermore, after a given operating time, the store of particles outside the plate becomes greater and greater and clusters of particles end up being detached and coming back onto the steel strip.

The addition of a plate emerging at the surface of the liquid seal also forms a preferential site for trapping zinc dust.

Another solution consists in adding a frame to the surface of the liquid seal in the duct and surrounding the steel strip.

This arrangement does not make it possible to remove all the defects associated with the entrainment of zinc oxides and dross caused by the running of the steel strip.

This is because the zinc vapour at the liquid seal will condense on the walls of the frame and at the slightest disturbance, brought about by the vibrations or thermal inhomogeneities of the immersed strip, the walls of the frame become fouled and thus become regions of retention of foreign matter.

This solution can therefore operate only for a few hours, at best a few days, before itself becoming an additional cause of defects.

Thus, this solution deals only partly with the liquid seal and does not make it possible to achieve a very low defect density satisfying the requirements of customers desiring surfaces free of visual defects.

Also known is a solution which aims to clean the liquid seal by replenishing the bath of molten metal.

The replenishment is achieved by introducing pumped liquid zinc into the bath near the region where the steel sheet is immersed.

There are great difficulties in implementing this solution.

This is because it requires an extremely high pumping rate in order to provide an overflow effect and the pumped zinc injected at the liquid seal contains dross generated in the zinc bath.

Moreover, the pipe for replenishing the liquid zinc may cause scratches on the steel strip before it is immersed and is itself a source of defects caused by the accumulation of condensed zinc vapours above the liquid seal.

Also known is a process based on the replenishment of zinc at the liquid seal and in which this replenishment is accomplished by means of a stainless steel box surrounding the steel strip and emerging at the surface of the liquid seal. A pump sucks off the particles entrained by the overflow thus created and delivers them into the volume of the bath.

This process also requires a very high pumping rate in order to maintain a permanent overflow effect insofaras the box surrounding the strip in the volume of the bath above the bottom roller cannot be hermetically sealed.

SUMMARY OF THE INVENTION

The object of the invention is to provide a process and a plant for the continuous galvanising of a metal strip which make it possible to avoid the abovementioned drawbacks and to achieve the very low density of defects meeting the requirements of customers desiring surfaces free of visual defects.

The subject of the invention is therefore a process for the continuous dip-coating of a metal strip in a tank containing a liquid metal bath, in which process the metal strip is made to run continuously, in a protective atmosphere, through a duct, the lower part of which is immersed in the liquid metal bath in order to define with the surface of the said bath, and inside this duct, a liquid seal, the metal strip is deflected around a deflector roller placed in the metal bath and the coated metal strip is wiped on leaving the metal bath, characterised in that a natural flow of the liquid metal from the surface of the liquid seal is set up in an overflow compartment made in the said duct and having an internal wall which extends the duct in its lower part and at least facing that side of the strip lying on the same side as the deflector roller, the upper edge of the compartment being positioned below the said surface and the drop in height of the liquid metal in this compartment being determined in order to prevent metal oxide particles and intermetallic compound particles from rising as a countercurrent to the flow of liquid metal and the level of liquid metal in the said compartment is maintained at a level below the surface of the liquid seal.

The subject of the invention is also a plant for the continuous dip-coating of a metal strip, of the type comprising:

- a tank containing a liquid metal bath,
- a duct through which the metal strip in a protective atmosphere runs and the lower part of which duct is immersed in the liquid metal bath in order to define with the surface of the said bath, and inside this duct, a liquid seal,
- a roller, placed in the metal bath, for deflecting the metal strip and
- means for wiping the coated metal strip on leaving the metal bath, characterised in that the duct is extended, in its lower part and facing that side of the strip lying on the same side as the deflector roller, by an internal wall directed towards the surface of the liquid seal, the upper edge of which internal wall is positioned below the said surface and forming a compartment for overflow of the liquid metal, provided with means for maintaining the level of liquid metal in the said compartment at a level below the surface of the liquid seal in order to set up a natural flow of the liquid metal from this surface towards this compartment, the drop in height of the liquid metal in this compartment being greater than 50 mm in order to prevent the metal oxide particles and intermetallic compound particles from rising as a countercurrent to the flow of liquid metal.

According to other features of the invention:

- the duct is extended, in its lower part and facing that side of the strip lying on the opposite side from the deflector roller, by an internal wall directed towards the surface of the liquid seal, the upper edge of which internal wall is positioned above the said surface and forming a sealed compartment for storing the metal oxide particles;
- the drop in height of the liquid metal in the overflow compartment is greater than 100 mm;
- the internal wall of each compartment has a lower part flared out towards the bottom of the tank and an upper part parallel to the metal strip;
- the means for maintaining the level of liquid metal in the overflow compartment are formed by a pump connected on the suction side to the said compartment via a connecting pipe and provided on the delivery side with a pipe for discharging the withdrawn metal into the volume of the bath;
- the plant includes means for displaying the level of liquid metal in the overflow compartment;
- the display means are formed by a reservoir placed outside the duct and connected to the base of the overflow compartment via a connection pipe;
- the duct is extended, in its lower part and facing each lateral edge of the metal strip, by an internal wall directed towards the surface of the liquid seal whose upper edge is positioned below the said surface and forming a liquid metal overflow compartment.

BRIEF DESCRIPTION OF THE DRAWINGS

Further features and advantages of the invention will become apparent from the description which follows, given by way of example, with reference to the appended drawings in which.

DETAILED DESCRIPTION OF THE INVENTION

In, the following, a description will be given in the case of a process and a plant for the continuous galvanising of a metal strip. However, the invention applies to any continuous dip-coating process in which surface pollution may occur and for which a clean liquid seal must be maintained.

Firstly, on leaving the cold-rolling mill train, the steel strip 1 passes, in a reducing atmosphere, through an annealing furnace (not shown) for the purpose of recrystallising it after the substantial work hardening resulting from the cold rolling, and to prepare its chemical surface state so as to favour the chemical reactions needed for the galvanising operation.

The steel strip is heated in this furnace to a temperature of between, for example, 650 and 900° C.

Figure 1:
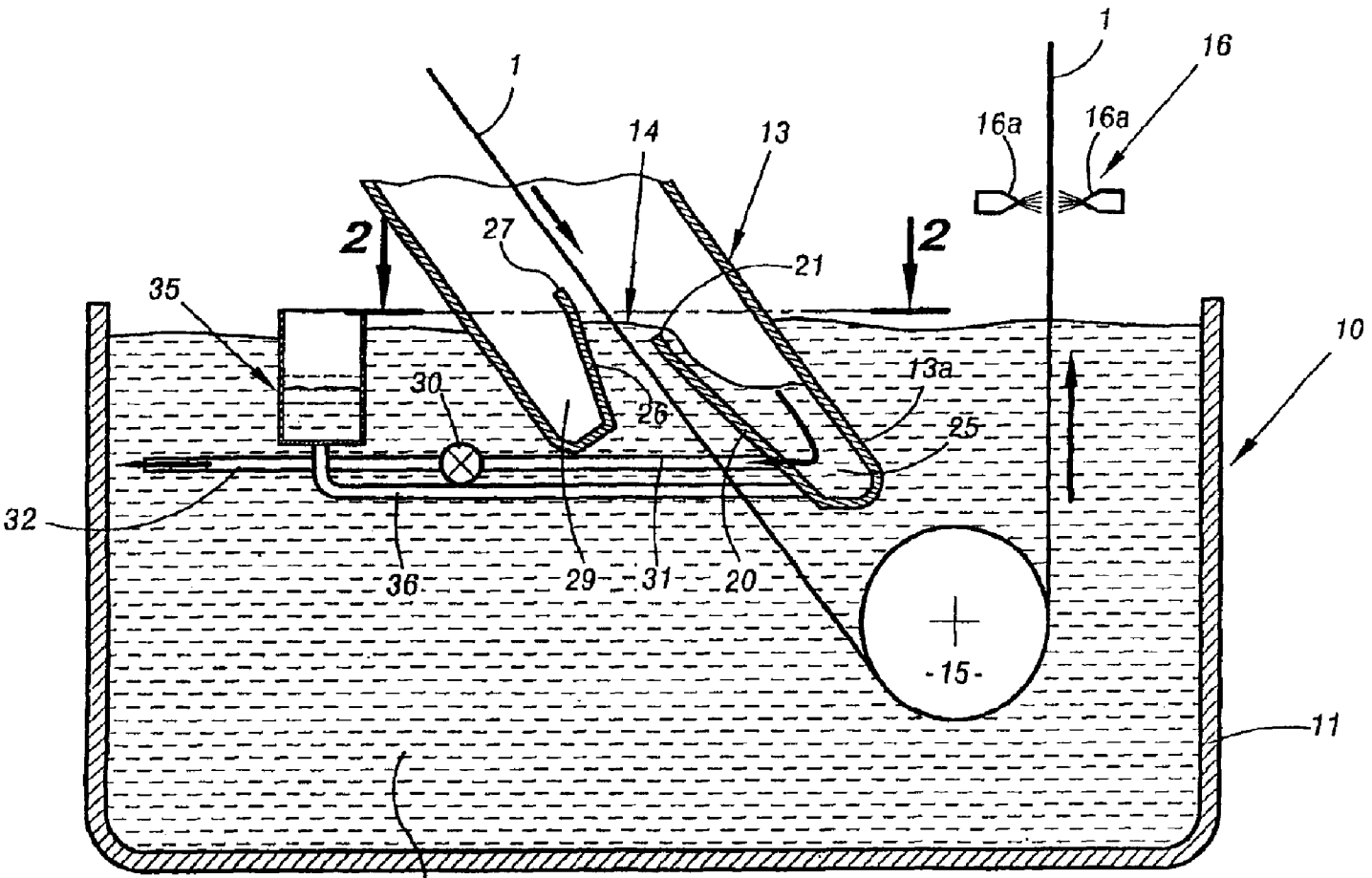
FIG. 1 is a schematic side view of a continuous dip-coating plant according to the invention.

On leaving the annealing furnace, the steel strip 1 passes through a galvanising plant, shown in FIG. 1 and denoted by the overall reference 10.

This plant 10 comprises a tank 11 containing a bath 12 of liquid zinc which contains chemical elements such as aluminium and iron and possible addition elements such as, in particular, lead and antimony.

The temperature of this liquid zinc bath is around 460° C.

On leaving the annealing furnace, the steel strip 1 is cooled to a temperature close to that of the liquid zinc bath by means of heat exchangers and is then immersed in the liquid zinc bath 12.

During this immersion, an Fe—Zn—Al intermetallic alloy is formed on the surface of the steel strip 1, this alloy allowing bonding between the steel strip and the zinc remaining on the said steel strip 1 after wiping.

As shown in FIG. 1, the galvanising plant 10 includes a duct 13 within which the steel strip 1 runs in an atmosphere which protects the steel.

This duct 13, also called "snout", has, in the illustrative example shown in the figures, a rectangular cross-section.

The lower part 13*a* of the duct 13 is immersed in the zinc bath 12 so as to define with the surface of the said bath 12, and inside this duct 13, a liquid seal 14.

Thus, the steel strip 1 on being immersed in the liquid zinc bath 12 passes through the surface of liquid seal 14 in the lower part 13*a* of the duct 13.

The steel strip 1 is deflected by a roller 15, usually called the bottom roller, placed in the zinc bath 12. On leaving this zinc bath 12, the coated steel strip 1 passes through wiping means 16 which consist, for example, of air spray nozzles 16*a* and which are directed towards each side of the steel strip 1 in order to regulate the thickness of the liquid zinc coating.

Figure 2:
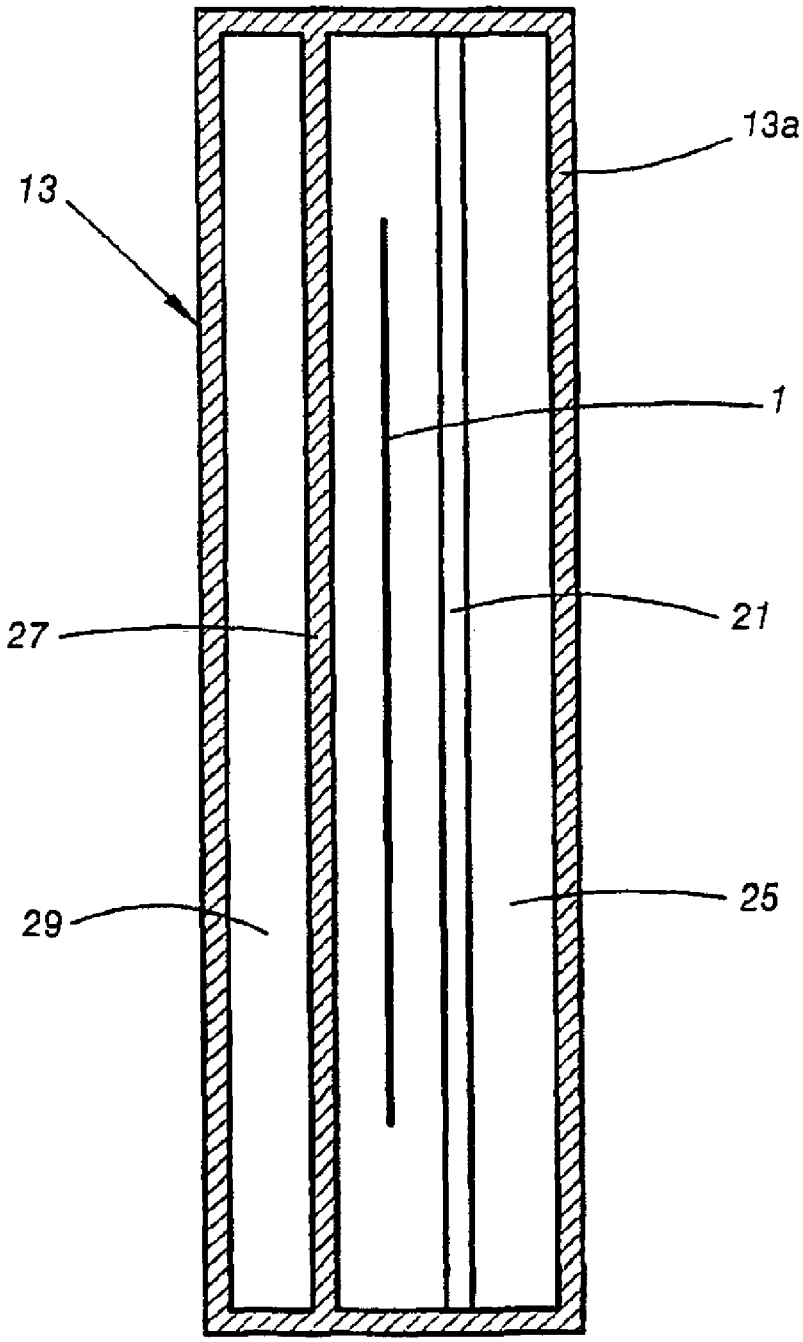
FIG. 2 is a sectional view of the duct on the line 2—2 in FIG. 1.

As shown in FIGS. 1 and 2, the lower part 13*a* of the duct 13 is extended, on the side facing that side of the strip 1 lying on the same side as the deflector roller 15, by an internal wall 20 which is directed towards the surface of the liquid seal 14 and makes, with the said lower part 13*a* of the duct 13, a liquid zinc overflow compartment 25, as will be seen later.

The upper edge 21 of the internal wall 20 is positioned below the surface of the liquid seal 14 and the compartment 25 is provided with means for maintaining the level of liquid zinc in the said compartment at a level below the surface of the liquid seal 14 in order to set up a natural flow of liquid zinc from this surface of the said liquid seal 14 towards this compartment 25.

Moreover, the lower part 13*a* of the duct 13, located so as to face that side of the strip 1 placed on the opposite side from the deflector roller 15, is extended by an internal wall 26 directed towards the surface of the liquid seal 14 and making with the said lower part 13*a* a sealed compartment 29 for storing particles, in particular zinc oxide particles.

The upper edge 27 of the internal wall 26 is positioned above the surface of the liquid seal 14.

The drop in height of the liquid metal in the overflow compartment 25 is determined in order to prevent the metal oxide particles and intermetallic compound particles from rising as a countercurrent to the flow of liquid metal and this drop is greater than 50 mm and preferably greater than 100 mm.

Preferably, the internal walls 20 and 26 have a lower part flared out towards the bottom of the tank 11. The internal walls 20 and 26 of the compartments 25 and 29 are made of stainless steel and have a thickness of between 10 and 20 mm for example.

Figure 3:
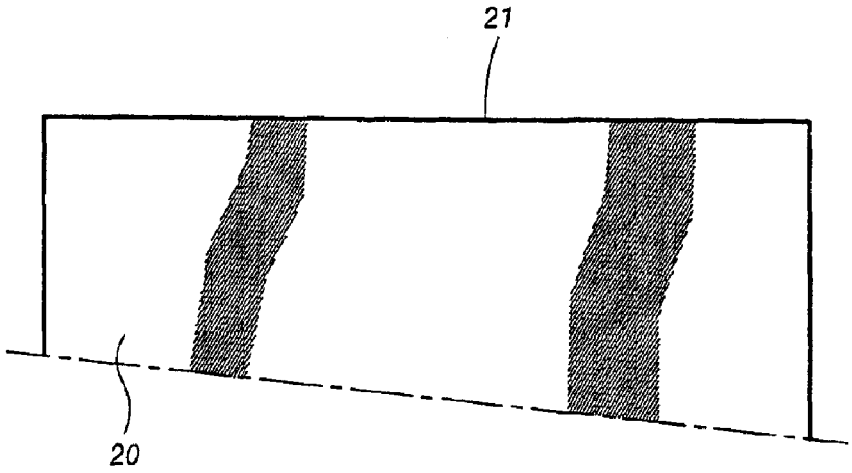
FIG. 3 is a schematic side view of a first embodiment of the upper edge of the overflow compartment of the plant according to the invention.

According to a first embodiment, shown in FIG. 3, the upper edge 21 of the internal wall 20 is straight and preferably tapered.

Figure 4:
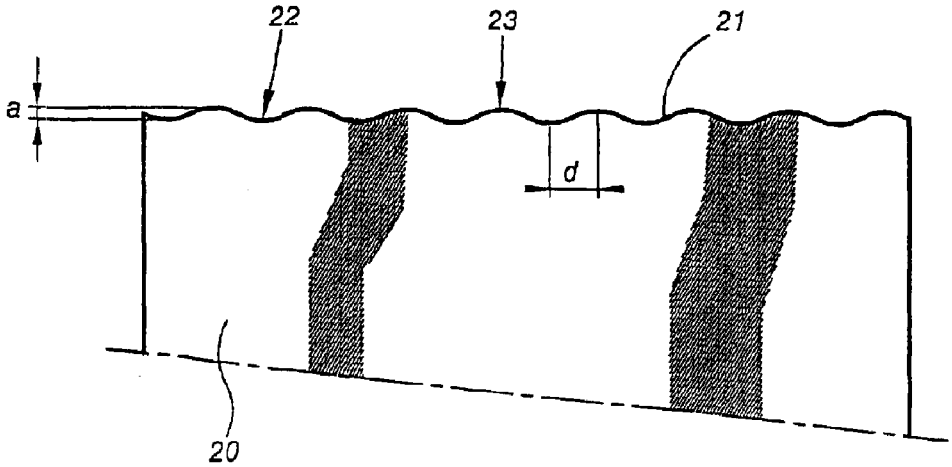
FIG. 4 is a schematic side view of a second embodiment of the upper edge of the overflow compartment of the plant according to the invention.

According to a second embodiment, shown in FIG. 4, the upper edge 21 of the internal wall 20 of the overflow compartment 25 comprises, in the longitudinal direction, a succession of hollows 22 and projections 23.

The hollows 22 and the projections 23 are in the form of circular arcs and the difference in height "a" between the said hollows and the said projections is preferably between 5 and 10 mm.

In addition, the distance "d" between the hollows 22 and the projections 23 is, for example, of the order of 150 mm.

Again in this embodiment, the upper edge 21 of the internal wall 20 is preferably tapered.

The means for maintaining the level of liquid zinc in the overflow compartment 25 are formed by a pump 30 connected on the suction side to the said compartment 25 via a connecting pipe 31 and provided on the delivery side with a pipe 32 for discharging the withdrawn zinc into the volume of the bath 12.

Moreover, the plant also includes means for displaying the level of liquid zinc in the overflow compartment 25 or any other means allowing the level of the liquid zinc to be displayed.

In a preferred embodiment, these display means are formed by a reservoir 35 placed outside the duct 13 and connected to the base of the overflow compartment 25 via a connection pipe 36.

As shown in FIG. 1, the point where the pump 30 is connected to the overflow compartment 25 lies above the point where the reservoir 35 is connected to the said compartment 25.

The addition of the external reservoir 35 makes it possible to transfer the level of the overflow compartment 25 to the outside of the lower part 13*a* of the duct 13, into a more propitious environment so that this level can be easily detected. For this purpose, the reservoir 35 may be equipped with a liquid zinc level detector such as, for example, a contactor supplying a warning lamp, a radar or a laser beam.

Figure 5:
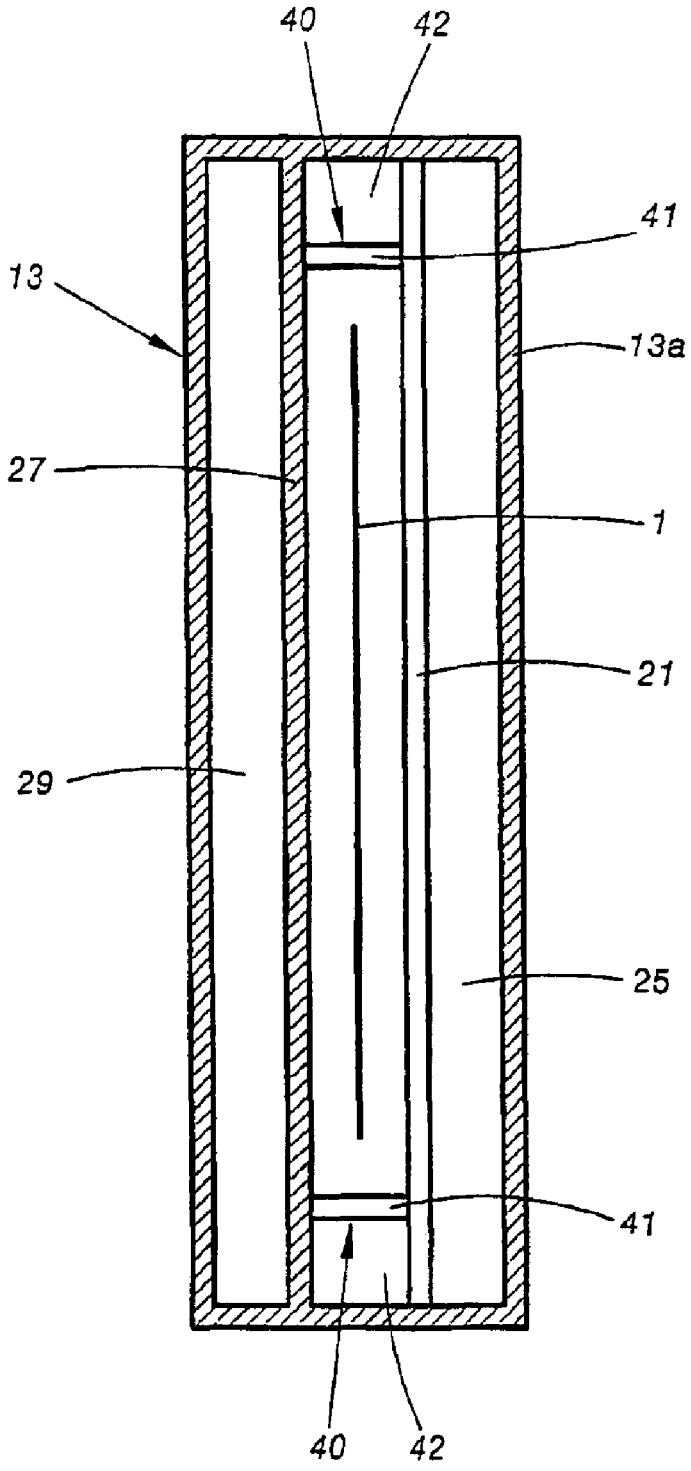
FIG. 5 is a schematic cross-sectional view of a variant of the duct of the plant according to the invention.

According to a variant shown in FIG. 5, the duct 13 is extended, in its lower part and facing each lateral edge of the steel strip 1, by an internal wall 40 directed towards the surface of the liquid seal 14 and the upper edge 41 of which internal wall 40 is positioned below the said surface of the liquid seal 14.

Each internal wall 41 makes, with the lower part of the duct 13, a liquid zinc overflow compartment 42.

In general, the steel strip 1 penetrates the zinc bath 12 via the duct 13 and the liquid seal 14, and this strip entrains zinc oxides and dross coming from the bath, thus creating visual defects in the coating.

To avoid this drawback, the area of the liquid seal 14 is reduced by the internal walls 20 and 26 and the surface of the liquid seal 14 isolated between the said walls 20 and 26 flows into the overflow compartment 25, passing over the upper edge 21 of the internal wall 20 of the said compartment 25.

The oxide particles and the dross or other particles which float on the surface of the liquid seal 14 and which are the cause of visual defects, are entrained into the overflow compartment 25 and the liquid zinc contained in this compartment 25 is pumped so as to maintain a depressed level sufficient to allow the natural flow of the zinc from the surface of the liquid seal 14 towards this compartment 25.

In this way, the free surface of the liquid seal 14 isolated between the two walls 20 and 26 is permanently replenished and the liquid zinc sucked up by the pump 30 from the compartment 25 is injected into the zinc bath 12 at the rear of the tank 11 by the discharge pipe 32.

By means of the effect thus created, the steel strip 1 upon immersion runs through the permanently cleaned surface of the liquid seal 14 and emerges from the zinc bath 12 with the minimum of defects.

The sealed compartment 29 acts as a receptacle for the zinc oxides or other particles which can come from the inclined lower wall of the duct and is used to retain these oxides so as to protect the seal strip 1.

The external reservoir 35 is used to detect the level of liquid zinc in the overflow compartment 25 and to adjust this level so as to maintain it below the level of the bath 12 by acting, for example, on the zinc ingots introduced into the tank 11.

If the plant comprises in addition to the overflow compartment 25 two lateral overflow compartments 42, the effectiveness of the plant is substantially increased.

By virtue of the plant according to the invention, the density of defects on the coated surfaces of the steel strip is substantially reduced and the surface quality thus obtained of this coating meets the criteria required by customers desiring parts whose surfaces are free of visual defects.

The invention applies to any metal dip-coating process.

What is claimed is:

1. A process for the Continuous dip-coating of a metal strip (1) in a tank (11) containing a liquid metal bath (12), in which process the metal strip (1) is made to run continuously, in a protective atmosphere, through a duct (13), the lower part **(13*a*) of which is immersed in the liquid metal bath (12) in order to define with the surface of the bath, and inside this duct (13), a liquid seal (14), the metal strip (1) is deflected around a deflector roller placed in the metal bath (12), and the coated metal strip (1) is wiped on leaving the metal bath (12), characterised in that a natural flow of the liquid metal from the surface of the liquid seal (14) is set up in an overflow compartment (25) made in the duct and having an internal wall which extends the duct (13) in its lower part and at least facing that side of the strip (1) lying on the same side as the deflector roller (15), an upper edge (21) of the compartment (25) is positioned below the surface, the drop in height of the liquid metal in this compartment (25) is maintained greater than 50 mm in order to prevent metal oxide particles and intermetallic compound particles from rising as a countercurrent to the flow of liquid metal, the level of liquid metal in the compartment (25) is maintained at a level below the surface of the liquid seal (14), and the duct (13) is extended, in its lower part (13*a*) and facing that side of the strip (1) lying on the opposite side from the deflector roller (15), by a second internal wall (26) directed towards the surface of the liquid seal (14), the upper edge (27) of which internal wall (26) is positioned above said surface and forming a sealed compartment (29)** for storing the metal oxide particles.

2. A plant for the continuous dip-coating of a metal strip (1), of the type comprising:

a tank (11) containing a liquid metal bath (12), a duct (13) through which the metal strip (1) in a protective atmosphere runs and the lower part **(13*a*) of which duct (13) is immersed in the liquid metal bath (12) in order to define with the surface of the bath (12), and inside this duct (13), a liquid seal (14), a roller (15), placed in the metal bath (12), for deflecting the metal strip (1), and means (16) for wiping the coated metal strip (1) on leaving the metal bath (12), characterised in that the duct (13) is extended, in its lower part (13*a*) and facing that side of the strip (1) lying on the same side as the deflector roller (15), by a first internal wall (20) directed towards the surface of the liquid seal (14), the upper edge (21) of which internal wall is positioned below the surface and forming an overflow compartment (25) for overflow of the liquid metal, provided with means (30) for maintaining the level of liquid metal in the compartment (25) at a level below the surface of the liquid seal (14) in order to set up a natural flow of the liquid metal from this surface towards this compartment (25), the drop in height of the liquid metal in this compartment being greater than 50 mm in order to prevent metal oxide particles and intermetallic compound particles from rising as a countercurrent to the flow of liquid metal, wherein the duct (13) is extended, in its lower part (13*a*) and facing that side of the strip (1) lying on the opposite side from the deflector roller (15), by a second internal wall (26) directed towards the surface of the liquid seal (14), the upper edge (27) of which internal wall (26) is positioned above said surface and forming a sealed compartment (29)** for storing the metal oxide particles.

3. Plant according to claim 2, characterised in that each of the first and second internal walls (20; 26) has a lower part flared out towards the bottom of the tank (11) and an upper part parallel to the metal strip (1).

4. Plant according to claim 2, characterised in that the drop in height of the liquid metal in the overflow compartment (25) is greater than 100 mm.

5. Plant according to claim 2, characterised in that the upper edge (21) of the first internal wall (20) of the overflow compartment (25) is straight.

6. Plant according to claim 2, characterised in that the upper edge (21) of the first internal wall (20) of the overflow compartment (25) comprises, in a longitudinal direction, a succession of hollows (22) and projections (23).

7. Plant according to claim 6, characterised in that the hollows (22) and the projections (23) are in the form of circular arcs.

8. Plant according to claim 6, characterised in that the difference in height between the hollows (22) and the projections (23) is between 5 and 10 mm.

9. Plant according to claim 6, characterised in that the distance between the hollows (22) and the projections (23) is of the order of 150 mm.

10. Plant according to claim 6, characterised in that the upper edge (21) of the first internal wall (20) of the overflow compartment (25) is tapered.

11. Plant according to claim 2, characterised in that each of the first and second internal walls (20; 26) is made of stainless steel and has a thickness of between 10 and 20 mm.

12. Plant according to claim 2, characterised in that the means for maintaining the level of liquid metal in the overflow compartment (25) are formed by a pump (30) connected on the suction side to the said compartment (25) via a connecting pipe (31) and provided on the delivery side with a pipe (32) for discharging the withdrawn metal into the volume of the bath (12).

13. Plant according to claim 12, characterised in that it includes means (35) for displaying the level of liquid metal in the overflow compartment (25).

14. Plant according to claim 13, characterised in that the display means are formed by a reservoir (35) placed outside the duct (13) and connected to the base of the overflow compartment (25) via a connection pipe (36).

15. Plant according to claim 14, characterised in that the point where the pump (30) is connected to the overflow compartment (25) lies above the point where the reservoir (35) is connected to the said compartment (25).

16. Plant according to claim 14, characterised in that the reservoir (35) forms a buffer container of liquid metal for the overflow compartment (25).

17. Plant according to claim 14, characterised in that the reservoir (35) is equipped with a liquid metal level detector.

18. Plant according to claim 2, characterised in that the duct (13) is extended, in its lower part (13*a*) and facing each lateral edge of the metal strip (1), by an internal wall (40) directed towards the surface of the liquid seal (14), whose upper edge (41) is positioned below the said surface and forming a liquid metal overflow compartment (42).

* * * * *